US005814780A

United States Patent [19]

Batchelder et al.

[11] Patent Number: 5,814,780

[45] Date of Patent: Sep. 29, 1998

[54] PIVOTABLE FLOAT SWITCH WITHIN A HOUSING

[75] Inventors: Scott K. Batchelder, Newburyport; James T. Burrill, Gloucester; Gary M. Sable, Newton Centre, all of Mass.

[73] Assignee: Rule Industries, Inc., Gloucester, Mass.

[21] Appl. No.: 720,145

[22] Filed: Sep. 25, 1996

[51] Int. Cl.[6] ..... H01H 35/18

[52] U.S. Cl. ..... 200/84 R; 73/322.15; 200/230

[58] Field of Search ..... 307/118; 73/308, 73/313, 317, 322.5; 340/623, 625; 417/40; 200/61.2, 61.52, 81.6, 81.9 HG, 84 R, 84 B, 190, 220, 230

[56] References Cited

U.S. PATENT DOCUMENTS

| | | | |
|---|---|---|---|
| Re. 34,175 | 2/1993 | Grimes | 200/84 R |
| 2,232,627 | 2/1941 | Olson . | |
| 3,440,375 | 4/1969 | Wood . | |
| 3,592,981 | 7/1971 | Rale | 200/84 B |
| 3,662,131 | 5/1972 | Leistiko . | |
| 3,864,538 | 2/1975 | Paradis et al. . | |
| 4,086,457 | 4/1978 | Niedermeyer . | |
| 4,223,190 | 9/1980 | Olson . | |
| 4,262,216 | 4/1981 | Johnston . | |
| 4,275,995 | 6/1981 | Taylor . | |
| 4,282,412 | 8/1981 | Florin . | |
| 4,399,338 | 8/1983 | Jones . | |
| 4,434,337 | 2/1984 | Becker . | |
| 4,468,546 | 8/1984 | Jones . | |
| 4,529,854 | 7/1985 | Johnston . | |
| 4,540,342 | 9/1985 | Steiner | 417/40 |
| 4,547,916 | 10/1985 | Henke | 4/300 |
| 4,572,934 | 2/1986 | Johnston . | |
| 4,575,597 | 3/1986 | Akhter . | |
| 4,778,957 | 10/1988 | Crowell . | |
| 4,904,830 | 2/1990 | Rizzuto . | |
| 4,940,861 | 7/1990 | Rizzuto . | |
| 5,175,402 | 12/1992 | Olson . | |
| 5,281,858 | 1/1994 | Langved . | |

*Primary Examiner*—Gerald P. Tolin

*Attorney, Agent, or Firm*—Dickstein Shapiro Morin & Oshinsky LLP

[57] ABSTRACT

A float switch having a housing, a pivoting float body and a tube containing mercury. The wires extend from the tube, into pivot arms of the float body, out of apertures within the arms and upwardly out an orifice in the top surface of the housing. The pivot arms include a pivot arm stop to center the float body within the housing. The pivot arms are sealed to prevent ingress of water into the tube. The housing includes dual rows of apertures to lessen the effects of clogging.

14 Claims, 5 Drawing Sheets

PIVOTABLE FLOAT SWITCH WITHIN A HOUSING

BACKGROUND

The present invention relates to switches and more particularly to float switches that function responsive to a rise in fluid level.

Float switches have been used in conjunction with bilge pumps for many years to evacuate water that has accumulated in the bilge of the boat. Similar switches have been utilized with sump pumps as well.

A conventional manner of operation of float switches is to provide a buoyant float body with a tube contained therein. In the tube is provided an open electrical circuit, usually in the form of two exposed wire ends, and means for closing the circuit. Generally, the means for closing the circuit is mercury. One end of the float body is pivotably supported on a housing surrounding the float switch. As water rises, one end of the buoyant float body rises with the water level, the other end being pivotably held in place.

Once the free end of the float body has risen to a certain angle, the means for closing the circuit is activated. Conventionally, this is accomplished by way of the mercury moving toward the pivoting end of the float and coming in contact with the exposed wires, thus closing the circuit. Closing the circuit allows the bilge, or similar, pump to run, thereby allowing the evacuation of the accumulated water.

To prevent frequent opening and closing of the circuit, and excessive cycling of the pump, it is desirable to both prolong the contact of the mercury with the exposed wires, despite the lowering water level, and to delay the contact of the mercury with the exposed wires until a predetermined water level has been reached. It is known that this may be accomplished by placing an obstacle in the path of the mercury or by forming the tube with a bend.

A conventional float switch is disclosed in U.S. Pat. No. 4,223,190 (Olson). Olson '190 is directed to a mercury float switch utilizing a glass tube housing the mercury and including a bend positioned parallel to the pivot axis. The glass tube is encased in the float body within a potting material to prevent its breakage. The float body is positioned in a protective housing. The float body is rigidly connected to a pivot shaft. The opposing ends of the shaft extend through and arc supported by two holes in the sides of the housing. Two circuit wires extend from an end of the mercury tube and into the pivot shaft, which is hollow. The longitudinal axis of the shaft is the pivot axis and acts as a pivot about which the float tilts. Each wire extends through and exits the hollow pivot shaft at its ends.

Another conventional float switch design is disclosed in U.S. Pat. No. 5,175,402 (Olson). Olson '402 is directed to a similar float switch as disclosed in Olson '190, except that both wires extend out one end of the hollow shaft and extend further to an end of the housing. A bracket for holding the wires is positioned at one end of the housing. The housing further has a row of apertures on the base of each sidewall.

Another conventional float switch design is disclosed in U.S. Pat. No. 4,778,957 (Crowell). Crowell is directed to a mercury float switch utilizing a similar mechanism as disclosed in Olson '190. However, instead of a potting material, Crowell shows the injection molding of a shroud material around the entire glass mercury tube, or in the alternative, around the end of the tube into which the contact wires enter the tube.

One problem inherent in conventional float switch designs such as disclosed in the two Olson references is that the wires extending outside of the housing from the pivot shaft, either from both ends or one end, are exposed to physical damage. Such physical damage can be exacerbated by the corrosive effects of the water, which may be salty or briny, in which the wires may dangle. Such corrosion could eventually lead to a defect in the float switch circuit, preventing the operation of the bilge, or similar, pump. Another problem in the float switch designs as disclosed in the two Olson references is that wires exiting the housing at the pivot axis could become tangled, and that could impede the pivoting movement of the float.

Another problem inherent in the float switch designs as disclosed in the two Olson references is that, especially in switches used with bilge pumps, the housing is often placed in a location where a person's feet could accidentally become entangled with the wires coming out of the sides of the housing. Such entanglement could damage the float switch, thus preventing the proper operation of the bilge pump.

Another problem with the float switch design as disclosed in the Olson references is the incorporation of the potting or shroud material. Such material adds weight to the float. Further, the addition of such material adds a step to the manufacture of the float switch, thus increasing the cost of manufacture.

Another problem with conventional float switch designs is that the apertures in the housing can easily become clogged by dirt and floating debris. The clogging of the apertures prevents sufficient ingress of water into the interior of the housing, thus preventing the float switch to properly function.

The float switch design of Crowell has two rows of apertures, but does not improve upon this defect in the prior art. The second row of apertures in the Crowell float switch are positioned such that, if the bottom apertures become completely clogged and allow no or very little ingress of water, the water level outside the housing will have to rise above the height of the pivot axis and the float body in order to obtain ingress into the housing, thus allowing for the pivot axis to be submerged under water for a lengthy period of time. Since the water level will be above the pivot axis of the float switch for a lengthy period of time, the possibility that water can gain ingress to the float body through any imperfections or cracks in the ends of the pivot arms of the float body is increased.

Further, the second row of apertures in Crowell are located above the position to which the float body, which contains the mercury tube, must descend in order to turn off the bilge pump. Thus, if the bottom row of apertures in Crowell are clogged, the water level will have to rise up to the second row of apertures to allow the float body to rise to the position at which the pump will turn on. However, the clogged bottom apertures will prevent drainage from inside the housing, and the float body will continue to remain above the position at which the pump turns off. Thus, the pump will not shut off when the bottom apertures of the Crowell device are clogged.

SUMMARY OF THE INVENTION

The present invention alleviates to a great extent the disadvantages of the prior art by providing a float switch including a housing with an upper surface, a float positioned within and pivotably attached to the housing and having a float body, two wires and a tube encompassing electrical connection means. The float body rotates about a pivot to effectuate a closing and opening of an electrical circuit. The wires exit the housing from the housing upper portion.

In one aspect of the invention, the housing encompasses a float body rotating about a pivot axis, and the sidewalls of the housing include apertures, some of which extend upwardly to the pivot axis.

It is therefore an object of the present invention to provide a float switch which limits exposure of the wires to the possibility of physical damage and has a prolonged life.

Another object of the present invention is to provide a float switch with wiring more logically consistent with and which takes advantage of the wiring present in boats.

Another object of the present invention is to provide a float switch with improved effectiveness of operation.

Another object of the present invention is to provide a float switch housing designed to lessen the effects of clogging due to debris floating in the water.

Another object of the present invention is to provide a tightly sealed float switch which is more compact, lighter in weight and less costly to manufacture than conventional float switches.

DETAILED DESCRIPTION OF PREFERRED EMBODIMENTS

Figure 1:
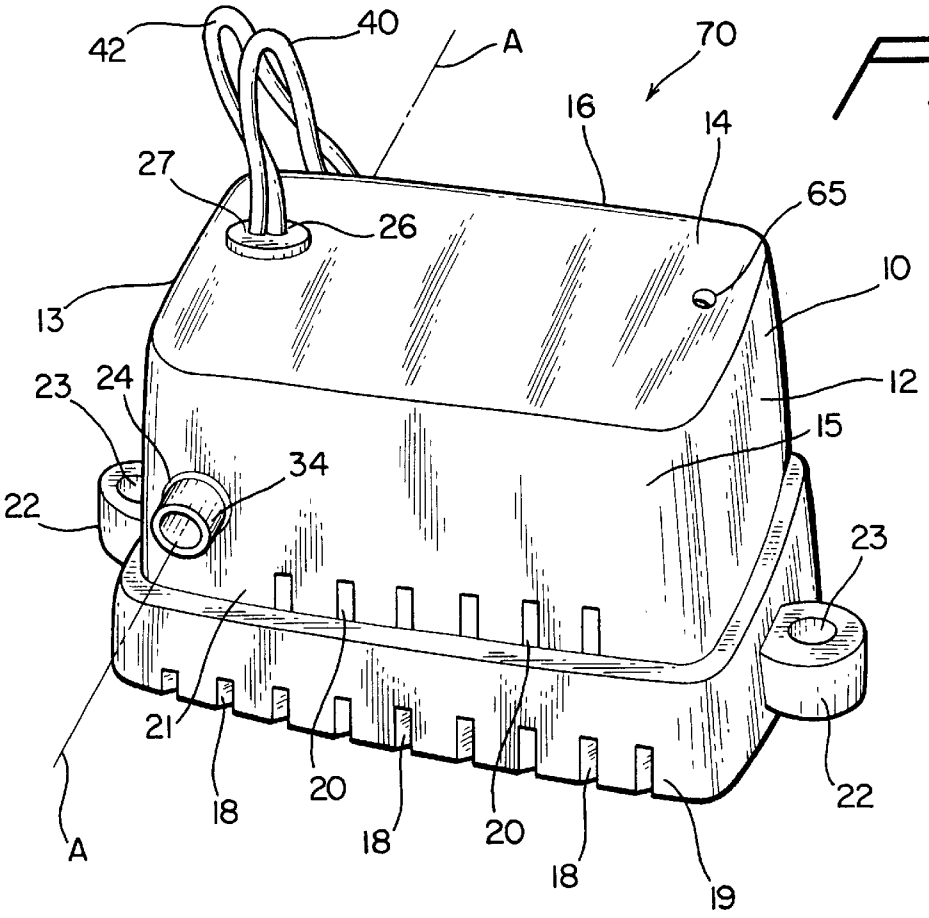
FIG. 1 is a perspective view of a preferred embodiment of the float switch according to the present invention.

Referring now to FIGS. 1–6, there being shown a float switch, generally designated by reference numeral 70, according to a preferred embodiment of the present invention, float switch 70 includes a housing 10, a float 30 and a mercury tube 50.

The housing 10 has a front wall 12, a back wall 13, a top surface 14, sidewalls 15, 16 and an open bottom 17. The top surface 14 includes a top surface orifice 26, and may include a strain relief 27 placed therein. The orifice 26 is located in the top surface 14 of the housing 10 to allow wires 40, 42 (to be described in detail below) to exit the housing 10. The strain relief 27 is positioned within orifice 26 in order to hold the wires 40,42 therein. The top surface 14 further includes a vent hole 65 positioned at an end of the housing 10 opposite from the orifice 26. The vent hole 65 functions in a conventional manner to release any build up of air or other gases within the housing 10.

Sidewall 15 has a circular pivot aperture 24 and sidewall 16 has a corresponding pivot aperture 25, both of the apertures 24 and 25 being formed through the thicknesses of sidewalls 15 and 16. Both of the apertures 24 and 25 are adapted to receive an end of the pivot arm (described in further detail below).

Each of the sidewalls 15 and 16 further includes a plurality of housing apertures 18 aligned in a first row 19 and a plurality of housing apertures 20 aligned in a second row 21. The housing 10 also includes a pair of mounting lugs 22, one each on the front and back walls 12 and 13. Each mounting lug 22 further includes a lug aperture 23 which receives a fastening implement, i.e., a nail or screw or the like, for fastening the housing to a base (not shown).

The plurality of housing apertures 18 and 20 are roughly rectangular in shape and each aperture 20 is positioned vertically above an aperture 18. The apertures 18 are of increasing height from the back wall 13 toward the front wall 12. Further, the plurality of housing apertures 20 are inclined upwardly such that the lower boundary of the second row 21 of apertures 20 is substantially parallel with the upper boundary of the first row 19 of apertures 18. Both of the rows 19 and 21 are aligned such that the highest extent of any of the apertures 18 and 20 is below the pivot axis A, which extends along the longitudinal axis of the pivot arms. Through this arrangement, if one or more of the apertures 18 nearest the back wall 13 become clogged, the apertures 18 which are nearer to the front wall 12 and which are taller in extent may remain at least partially open to allow continued ingress of water into the housing 10. Further, the second row 21 of apertures 20 remain unclogged while some or all of the apertures 18 become clogged, thus allowing ingress of water into the housing 10 while keeping the water level below the pivot axis A.

Additionally, this arrangement of rows allows the housing 10 to retain sufficient structural integrity so as to be able to act as protection for the float 30 against physical stress. Also, this arrangement acts to limit the amount of wave action inside the housing 10 due to rocking of the boat.

Alternatively, the housing 10 could have a plurality of extended height apertures 18 (not shown) instead of the dual rows 19 and 21 of apertures 18 and 20. At least some of the extended height apertures 18 could extend upwardly to the pivot axis A.

The float 30 includes a float body 32 having a base 31, and a neck 33 from which extends a pair of pivot arms 34 and 35. The pivot arm 34 extends from neck 33 out of the aperture 24 of the housing 10 and the pivot arm 35 extends from neck 33 out of the aperture 25 of the housing 10. The float body 32, neck 33 and pivot arms 34 and 35 are hollow and tightly sealed to prevent seepage of water. A longitudinal axis B extends through the neck 33 and float body 32 and is normal to pivot axis A. A tube 50 (described in further detail below) is positioned partially within the float body 32 and partially within the neck 33. More specifically, the tube 50 is positioned between two posts 80 and 81, which function to maintain the position of the tube 50 and prevent side-to-side and forward-to-backward movement of the tube 50.

Each of the pivot arms 34 and 35 includes a wire aperture 36 positioned between the neck 33 and the ends of the pivot arms. Wires 40 and 42 extend from the tube 50 into the neck 33. From the neck 33, each of the wires 40 and 42 extends down each of the pivot arms 34 and 35 and out of an aperture 36. After exiting the apertures 36, the wires 40 and 42 criss-cross beneath the pivot arms 34 and 35 and the neck 33 before extending upwardly and exiting the housing 10 through the top surface orifice 26 within the strain relief 27.

By criss-crossing the wires 40 and 42, a greater length of wire is utilized, which diminishes the strain on any given section of the wires due to the rotation of the pivot arms 34 and 35 and the upward and downward movement of the float body 32.

In addition, bringing the wires out the upper portion of the housing 10 makes it less likely that the wires will be damaged by any form of physical trauma or stress. Even if the wires experience any physical stress that causes a defect in the protective covering of the wires, any such exposed portion would be elevated above the water level and hence would not be subjected to the water's corrosive effects.

Further, this arrangement does not impede the operation of the pivot. Also, this arrangement allows for the pivot arms to be lower than in conventional designs where the wires extend out the pivot arms. Such conventional designs locate the pivot arms high enough to lessen the amount of exposure the wires have with water. In the present invention, the exit of the wires upwardly allows the pivot arms to be lowered, thus allowing for a more compact design.

Maintaining the position of the tube 50 makes unnecessary any potting material or shroud material to protect the tube 50 from physical trauma. Further, by tightly sealing the float body 32, the neck 33 and the pivot arms 34 and 35, the sealing characteristics of potting material or shroud material are also rendered unnecessary. Thus, this design provides for a float switch which is both lighter in weight and less costly to manufacture than conventional switch designs.

At least one of the pivot arms 34 and 35 may further include a pivot arm stop 38 positioned near the end of the arm. The pivot arm stops 38 lessen any binding of the pivot arms 34 and 35 within the housing 10. The pivot arm stops 38 may extend only part of the way around the circumference of the pivot arms 34 and 35. This arrangement allows the pivot axis A to be located closer to the back wall 13 of the housing 10, thus allowing for a smaller housing 10.

In addition, each of the pivot arms 34 and 35 further includes an O-ring 44 positioned in a conventional manner between the neck 33 and the wire aperture 36. Each of the wires 40 and 42 extends from the neck 33, through an O-ring 44 and out of a wire aperture 36. The positioning of the O-rings 44 limits the possibility that any water which may incidentally enter the ends of the pivot arms 34 and 35 from moving into the neck 33 or the float body 32.

The tube 50 includes mercury 60 and an aperture 52 at an end closest to the neck 33 and adapted to receive wire 40 into the interior of the tube. Wire 42 is connected to the exterior of the tube 50, which is conductive (such as formed from a metallic substance), thus making the tube one of the contacts. A ridge 54 is positioned at a location between and parallel to the ends of the tube 50.

Winding the wires tautly from the tube 50 through the O-rings 44 exerts a force on the tube 50 which pulls the tube backward against post 81 and assists in maintaining the position of the tube 50.

Figure 8:
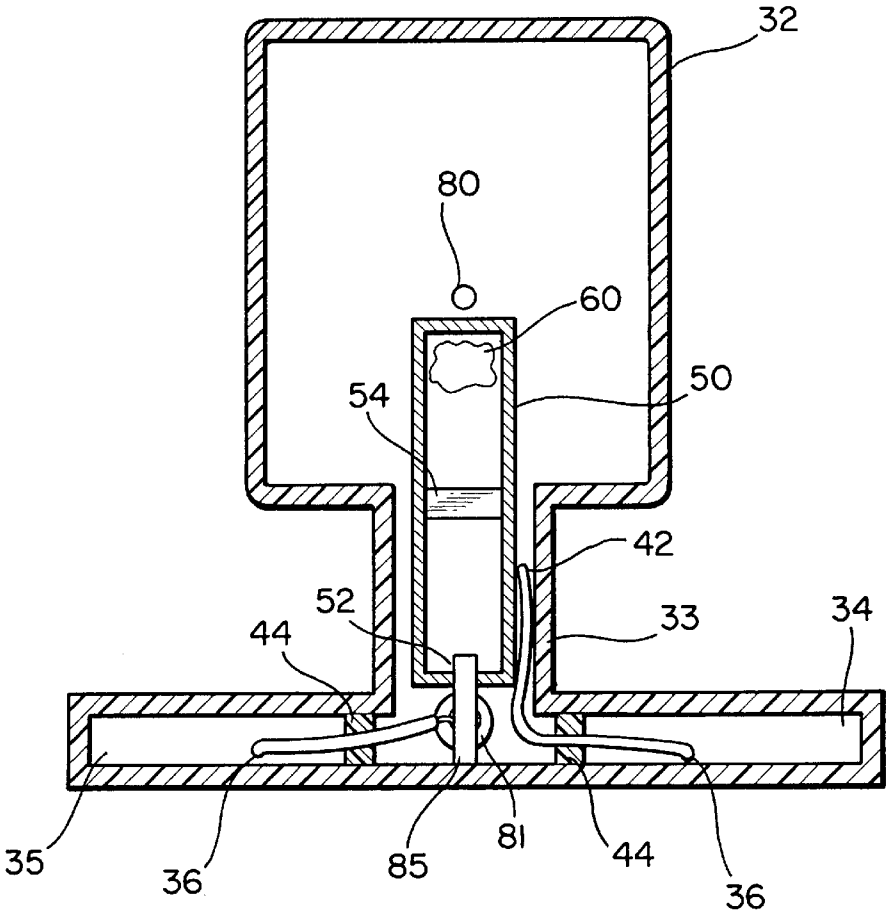
FIG. 8 is a cross-sectional view of another preferred embodiment of the float switch according to the present invention.
Figure 6:
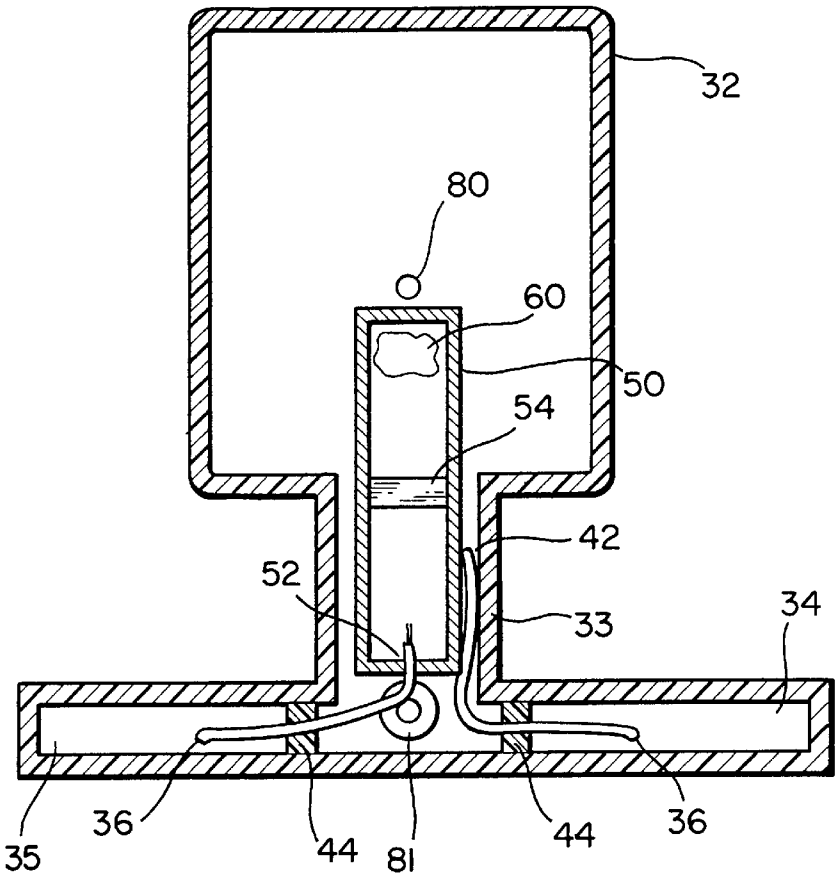
FIG. 6 is a cross-section view of the pivot arms and tube of the float switch of FIG. 1.

An alternative design, as shown in FIG. 8, includes an electrical contact 85 which is attached to an end of tube 50 and extends over post 81 toward the back wall 13 of the housing 10. Conventional insulation means (not shown) for insulating the contact 85 from the tube 50 are also provided. The wire 40 is connected by welding, soldering or other like means to the contact 85. Further, the contact 85 may be of sufficient length to come in contact with the back wall 13, thus assisting in maintaining the position of the tube 50.

Alternatively, the tube 50 may be formed of glass, with a bend positioned between the ends of the tube. The tube 50 so formed is positioned within the float 30 such that the end farthest from the neck 33 is bent downwardly toward the bottom 17 of the housing 10 and the end closest to the neck 33 receiving both wires 40 and 42 within the aperture 52.

Regardless of whether the tube 50 is formed of metal, glass or any other substance, the tube 50 is preferably mounted securely without the use of any potting or shroud material. Using such materials makes the float heavier and more costly. A heavier float is less responsive and requires a larger float body and housing to achieve the buoyancy to raise the float body during operation.

Through either of these arrangements, the mercury 60 is delayed in making and breaking contact with at least one of the wires 40 and 42, and thus delayed in closing and opening the float switch circuit which starts and stops the bilge, or similar, pump motor. Specifically, in a conductive tube 50 as described above, the ridge 54 prevents the mercury 60 from moving to the end of the tube 50 where wire 40 enters through the aperture 52, thereby closing the circuit. Once the longitudinal axis B is at a sufficient angle above the horizontal to overcome the surface tension and/or friction acting on the mercury 60, the mercury 60 will move beyond the ridge 54. Preferably, it is desired that the ridge 54 be so positioned and sized as to prevent closing of the circuit until the longitudinal axis B is between about 18 degrees and about 20 degrees above the horizontal (the pump-on position). Further, the mercury 60 remains in contact with both of the wires 40 and 42 entering the aperture 52 until the longitudinal axis B is lowered to a height which allows the mercury 60 to move back over the ridge 54, thereby breaking the circuit (the pump-off position). Preferably, the pump-off position is between about 6 degrees and about 10 degrees below the horizontal.

When the tube 50 is formed of glass (not shown), the bend in the glass provides the same function as the ridge 54 in the metallic tube. However, in the glass version, both wires 40 and 42 extend through the aperture 52. It is preferred that the bend be formed such that the pump-on position is between about 18 degrees and about 20 degrees above the horizontal and it is preferred that the pump-off position be between about 6 degrees and about 10 degrees below the horizontal. A sufficient amount of mercury 60 should be used in this arrangement to account for any side-to-side movement of the float assembly, caused for example by a rocking of the boat, to prevent an inadvertent breaking of the contact between the mercury 60 and any one of the wires 40 and 42.

The float 30, including the tube 50, is placed within the housing 10, and the housing 10 is attached to a base through fastening means positioned in the lug apertures 23 of the mounting lugs 22.

It is to be understood that other arrangements than the arrangement described above are within the scope of the present invention. For example, the housing 10 could be manufactured in shapes other than rectangular, such as hemispherical.

Further, instead of the pivot arm arrangement as described above, the neck 33 of the float 30 could have an orifice extending through its width for receiving a pin. The ends of the pin could further be received by opposing slots positioned on sides of an opening located on the back wall 13 of the housing 10, allowing rotation of the float body 32 with the movement of the water level.

Figure 7:
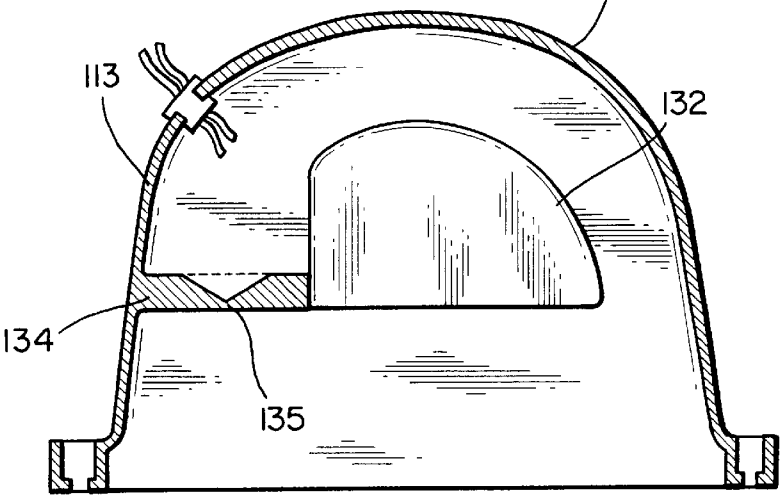
FIG. 7 is a schematic view of a cross-section of another preferred embodiment of the float switch according to the present invention.
Figure 2:
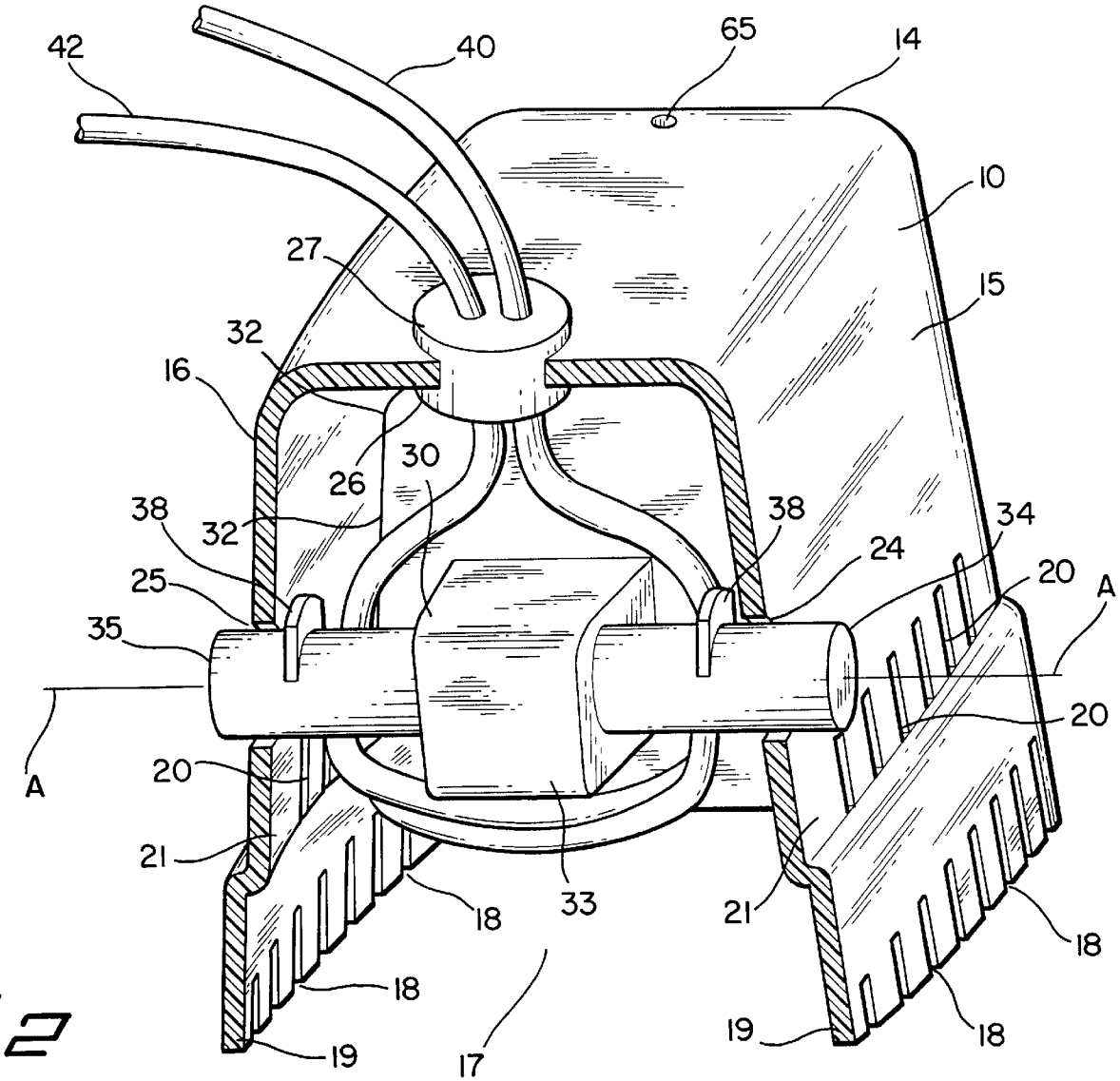
FIG. 2 is a partial cross-sectional perspective view of the float switch of FIG. 1 showing the pivot end of the float.
Figure 3:
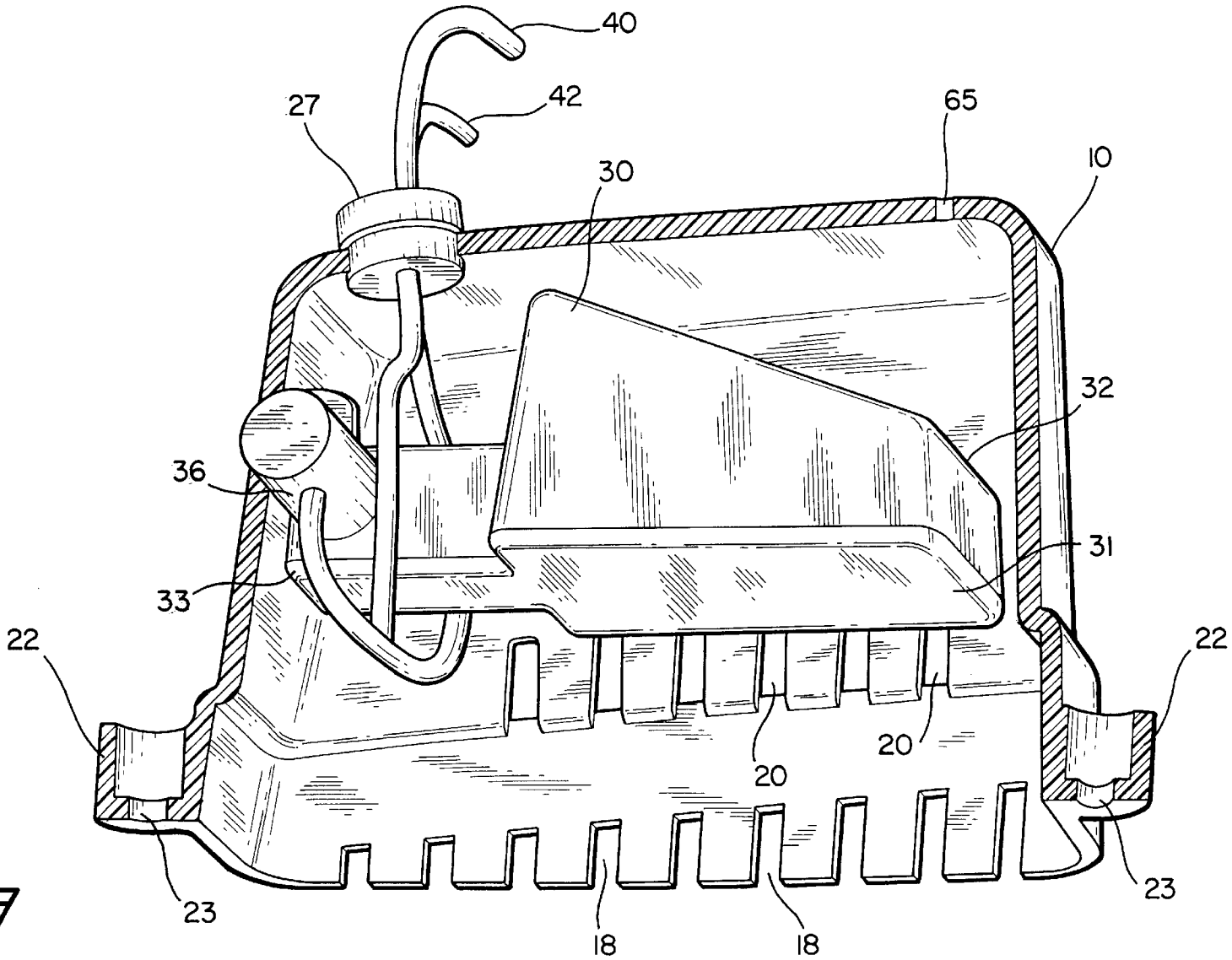
FIG. 3 is a partial cross-sectional perspective view of the float switch of FIG. 1 showing the underside of the float.
Figure 4:
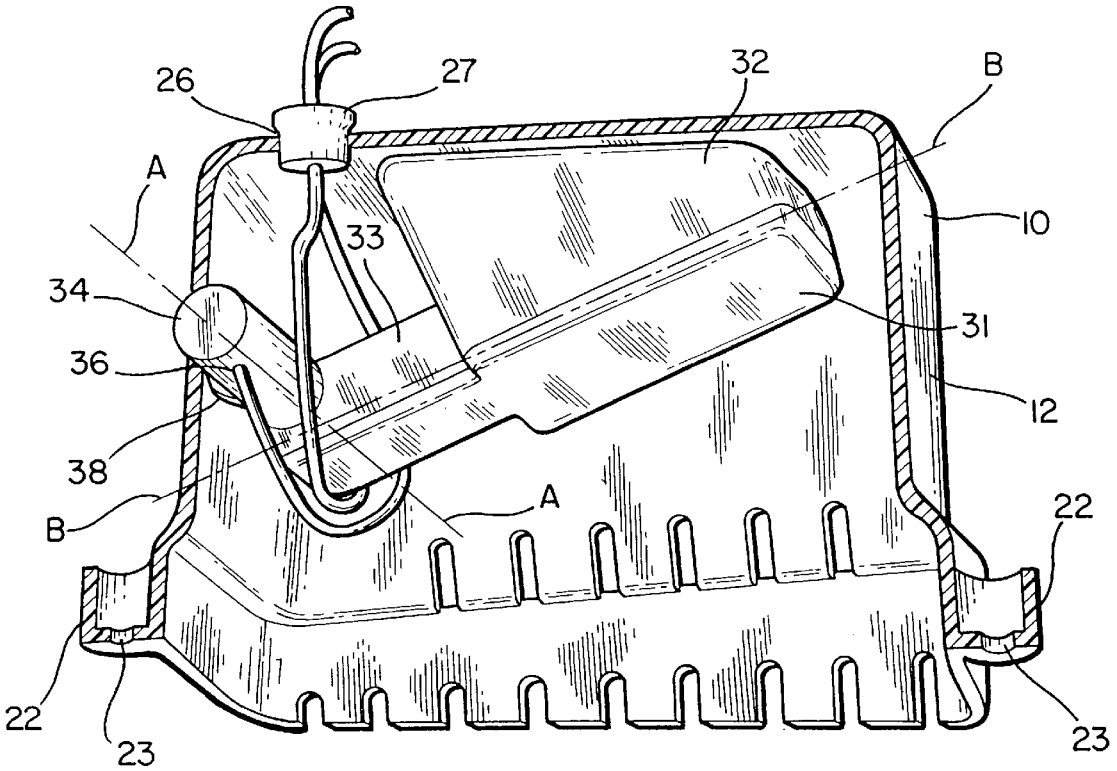
FIG. 4 is a view like FIG. 3 showing the float body positioned at its upper extent.
Figure 5:
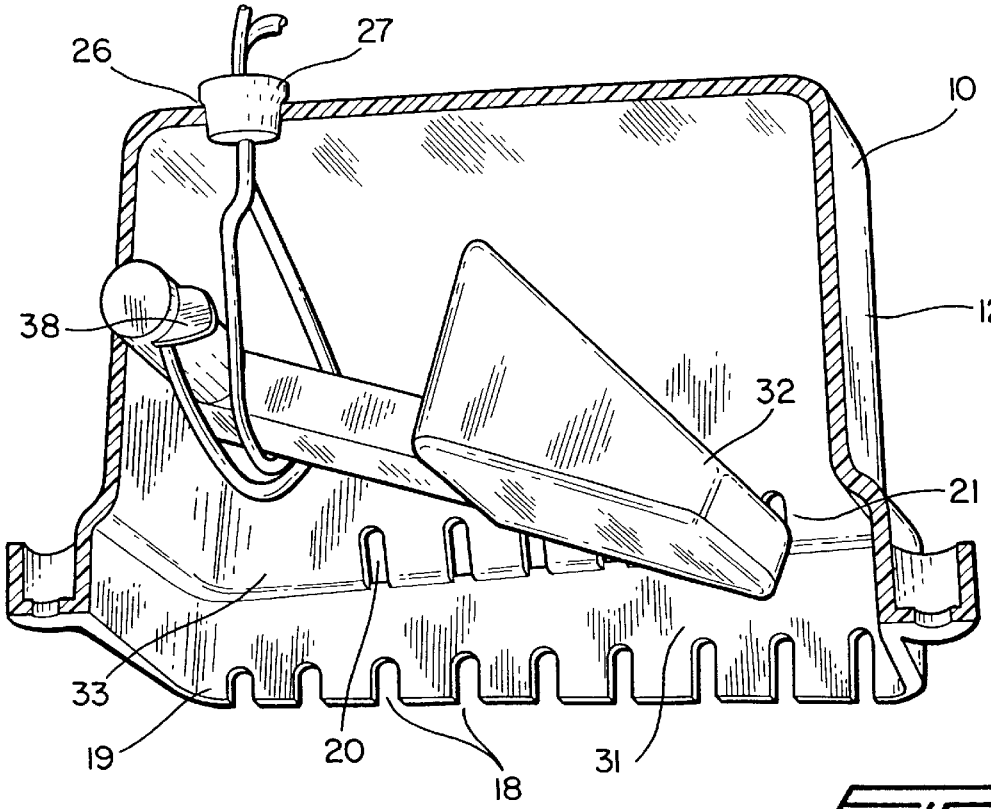
FIG. 5 is a view like FIG. 3 showing the float body positioned at its lower extent.

In another alternative arrangement, as shown in FIG. 7, the pivot arm 134 is formed of a flexible material with a generally uniform cross-section (as denoted by the dashed line) and formed integral with the wall 113 of a dome-shaped housing 110. The wires extend through the upper portion of the housing 110. For the sake of simplicity, not all the elements of the float switch of the present invention are shown in FIG. 7. The flexible nature of the arm 134 would allow the float body 132 to move upwardly and downwardly with the water level, the arm 134 flexing through all or part of its length. Preferably, the flexible arm 134 is designed and positioned such that there is minimal tension or stress occurring at the position where the circuit becomes closed (the pump-on position).

In addition, with reference to FIG. 7, as part of a flexible arm 134 arrangement, a living hinge 135 (solid line) could be utilized. This design allows for upward and downward movement of the float 132 with pivoting occurring primarily at the living hinge 135, although some flexing could occur along the balance of the length of the arm 134. Other variations in cross-section could also be utilized.

In operation, as the water level rises, the water enters the housing 10 through the lower row 19 of the housing apertures 18. As the water level continues to rise, the water comes into contact with the base 31 of the buoyant float body 32. As the water level continues to rise, the float body 32 floats on top of the water and pivots about pivot axis A. Eventually, the water level will rise to such an extent that the mercury 60 located in tube 50 will be able to move past ridge 54 in a metallic tube toward the opposite end of tube 50, making contact with at least one of the wires 40 and 42 extending into the tube 50 through the aperture 52 (the pump-on position).

When the mercury 60 closes the circuit, the bilge, or similar, pump motor starts and pumps out the water. The ridge 54 further acts to prevent the mercury 60 from breaking the electrical connection too quickly. The ridge 54 prevents the mercury 60 from breaking electrical contact with the wires 40 and 42 until the float body 32 has pivoted to a position below the position at which the mercury 60 first surpassed the ridge 54. Through this arrangement, the float switch is prevented from turning on and off repeatedly in quick succession.

The arrangement of the wires 40 and 42 extending through the pivot arms 34 and 35, out the apertures 36, and upwardly out through the strain relief 27 positioned in the top surface orifice 26 greatly diminishes the exposure of the wires 40 and 42 to contact with water. This arrangement additionally keeps the wires 40 and 42 from dangling about the housing 10 and being tripped over or becoming tangled up, thus impeding the rotational movement of the float body 32.

In addition, this arrangement takes advantage of the fact that most wiring in a boat is positioned vertically above the float switch by having the wires 40 and 42 exit the housing 10 from the orifice 26 in the top surface 14 of the housing 10.

Also, this arrangement lessens any physical resistance on the wiring caused by the rotation of the pivot arms 34 and 35 and prevents any significant physical resistance at the switch point.

Finally, this arrangement allows for the pivot axis A to be positioned more downwardly and backwardly than in conventional float switches, thus allowing for a smaller housing 10.

The arrangement of the present invention also addresses the problem of clogged housing apertures. Because water accumulating in a bilge is usually not clean, but includes dirt and floating debris, housing apertures often become clogged. However, with the dual lower and upper rows 19 and 21 of apertures 18 and 20, the present invention allows for continued ingress of water within the housing 10 even if the lower apertures 18 are completely or partially clogged. Further, the height of the apertures 18 are stepped from one end of the housing 10 to the other end. In this way, even if some of the apertures 18 are clogged, others of the apertures 18 will remain unclogged. Further, since both rows 19 and 21 are positioned beneath the pivot axis A, the likelihood that water will rise above the pivot axis A is greatly diminished, thus also lessening the possibility of water seeping into the float body 32 and adversely affecting the operation of the float switch.

What is new and desired to be protected by Letters Patent of the United States is:

We claim:

1. A float switch operated by rotating a member to open and close an electrical circuit, said float switch comprising:

a housing having a pair of opposing pivot arm apertures;

a float body positioned within and pivotably attached to said housing, said float body pivoting about a pivot axis, said float body including a neck and a pair of pivot arms, each said arm extending from said neck out of each said pivot arm aperture, said pivot arms being hollow; and a pair of wires for carrying an electrical current in the electrical circuit, said wires being supported within said pivot arms, wherein each said wire exits from a respective pivot arm through a wire aperture, loops around said neck, and exits said housing at a position above said pivot axis.

2. The float switch of claim 1, further comprising an O-ring positioned in each of said pivot arms between each said wire aperture and said neck.

3. The float switch of claim 2, said housing further comprising an upper surface, said wires exiting said housing through an opening in said upper surface.

4. The float switch of claim 3, wherein a strain relief is positioned within said opening in said upper surface.

5. The float switch of claim 4, wherein at least one of said pivot arms further includes a stop for centering said float within said housing.

6. The float switch of claim 5, said float body further including a tube, said pair of wires extending from said tube, at least one of said wires extending into said tube, said tube encompassing a conducting material for the opening and closing of the electrical circuit between said wires.

7. The float switch of claim 6, wherein said tube is composed of metal and further includes a ridge positioned within and parallel to a longitudinal axis of said pivot arms.

8. A float switch comprising:

a housing having a top surface, front and back walls and a pair of sidewalls, each said sidewall including a pivot arm aperture;

a float having a float body, a float tube, a pair of wires extending from said float tube and at least one of said wires extending into said float tube, and a conducting material to close an electrical circuit between said wires; and said float body including a neck and a pair of pivot arms, each said arm extending from said neck out of each said pivot arm aperture, said pivot arms being hollow and supporting therewithin said wires, each said pivot arm including a wire aperture, each said wire extending through each said wire aperture and looping around said neck, at least one of said pivot arms further including a stop for centering said float within said housing.

9. The float switch of claim 8, wherein said tube is composed of metal.

10. The float switch of claim 9, wherein said tube further includes a ridge positioned within and parallel to a longitudinal axis of said pivot arms.

11. A float switch operated by rotating a member to open and close an electrical circuit, said float switch comprising:

a housing having a pair of opposing pivot arm apertures, said housing including a pivot axis, front and back walls and sidewalls, each said sidewall further including a plurality of apertures, at least some of said plurality of apertures extending up to said pivot axis;

a float body positioned within and pivotably attached to said housing, said float body pivoting about said pivot axis and including a neck and a pair of pivot arms, each said arm extending from said neck out of each said pivot arm aperture, said pivot arms being hollow; and a pair of wires for carrying an electrical current in the electrical circuit, said wires being supported within said pivot arms, wherein each said wire exits from a respective pivot arm through a wire aperture, loops around said neck, and exits said housing at a position above said pivot axis.

12. The float switch of claim 11, wherein said plurality of apertures are arranged in a first row and a second row, said second row being positioned above said first row.

13. The float switch of claim 12, wherein the height of said apertures in said first row increases from said back wall to said front wall.

14. The float switch of claim 13, wherein the lowest extent of said second row of apertures is parallel to the upper extent of said first row.

* * * * *